US007297020B2

(12) United States Patent
Takahira

(10) Patent No.: US 7,297,020 B2
(45) Date of Patent: Nov. 20, 2007

(54) CABLE CONNECTOR

(75) Inventor: Hiroshi Takahira, Kawasaki (JP)

(73) Assignee: Yamaichi Electronics Co., Ltd., Tokyo (JP)

( * ) Notice: Subject to any disclaimer, the term of this patent is extended or adjusted under 35 U.S.C. 154(b) by 0 days.

(21) Appl. No.: 11/480,830

(22) Filed: Jul. 6, 2006

(65) Prior Publication Data

US 2007/0010127 A1 Jan. 11, 2007

(30) Foreign Application Priority Data

Jul. 7, 2005 (JP) ..... 2005-199018
Jun. 13, 2006 (JP) ..... 2006-163733

(51) Int. Cl.
*H01R 12/24* (2006.01)

(52) U.S. Cl. ..... 439/495

(58) Field of Classification Search ..... 439/495, 439/492, 260, 267, 157
See application file for complete search history.

(56) References Cited

U.S. PATENT DOCUMENTS 4,189,200 A 2/1980 Yeager et al.
4,630,874 A 12/1986 Renn et al.
5,458,506 A * 10/1995 Yamaguchi et al. ..... 439/495
5,580,257 A 12/1996 Harwath
5,709,573 A 1/1998 McClure
6,099,346 A * 8/2000 Hashiguchi et al. ..... 439/495
6,123,558 A 9/2000 Shibata
6,203,345 B1 * 3/2001 Roque et al. ..... 439/260
6,210,174 B1 4/2001 Pei et al.
6,210,209 B1 4/2001 Wu et al.
6,383,017 B1 * 5/2002 Takayasu ..... 439/495
6,431,897 B1 * 8/2002 Hashiguchi et al. ..... 439/267
6,471,541 B2 10/2002 Kunishi et al.
6,602,083 B2 8/2003 Tsunematsu
6,755,682 B2 * 6/2004 Kunishi et al. ..... 439/495
6,767,233 B2 * 7/2004 Tsunematsu ..... 439/260
6,790,074 B1 * 9/2004 Chiu ..... 439/495
6,851,968 B2 * 2/2005 Tsunematsu ..... 439/495
6,855,009 B2 2/2005 Nishiyama
6,863,559 B2 3/2005 Yu
6,869,307 B2 3/2005 Endo
6,921,274 B2 * 7/2005 Yu ..... 439/260
6,971,908 B2 * 12/2005 Shiu et al. ..... 439/495
2002/0106924 A1 8/2002 Uehara (Continued)

FOREIGN PATENT DOCUMENTS

JP 59-110990 U 7/1984

(Continued)

OTHER PUBLICATIONS

Chinese Office Action and English Translation for Chinese Patent Application No. 2004100807089, dated Mar. 10, 2006.

(Continued)

*Primary Examiner*—Tulsidas C. Patel
*Assistant Examiner*—Vladimir Imas
(74) *Attorney, Agent, or Firm*—Finnegan, Henderson, Farabow, Garrett & Dunner, LLP

(57) ABSTRACT

In a cable connector, a sliding surface in a pressing portion of an actuator member is rotatable or movable relative to an arc-shaped portion and slant part of a contact terminal.

4 Claims, 17 Drawing Sheets

U.S. PATENT DOCUMENTS

| | | | | |
|---|---|---|---|---|
| 2003/0092310 | A1* | 5/2003 | Kunishi et al. | 439/495 |
| 2006/0172590 | A1* | 8/2006 | Yamada et al. | 439/495 |

FOREIGN PATENT DOCUMENTS

| | | | |
|---|---|---|---|
| JP | 63-83779 | U | 6/1988 |
| JP | 07-057825 | | 3/1995 |
| JP | 8-148222 | A | 6/1996 |
| JP | 08-306446 | | 11/1996 |
| JP | 2692055 | | 9/1997 |
| JP | 2000-251024 | | 9/2000 |
| JP | 2000-251025 | | 9/2000 |
| JP | 2001-357920 | | 12/2001 |
| JP | 2002-231348 | | 8/2002 |
| JP | 2002-270261 | A | 9/2002 |
| JP | 2002-289284 | | 10/2002 |
| JP | 03-425696 | | 5/2003 |
| JP | 3446136 | | 7/2003 |
| JP | 3513751 | | 1/2004 |
| JP | 3579827 | | 7/2004 |

OTHER PUBLICATIONS

Co-pending U.S. Appl. No. 10/954,491; Title: Connector for Flexible Printed Circuit Board; U.S. Filing Date: Oct. 1, 2004.

Co-Pending U.S. Appl. No. 11/516,561; U.S. Filing Date: Sep. 7, 2006.

Co-Pending U.S. Appl. No. 11/585,823; U.S. Filing Date: Oct. 25, 2006.

Office Action in co-pending U.S. Appl. No. 10/400,678 dated Jun. 10, 2004.

Office Action in co-pending U.S. Appl. No. 10/464,538 dated Jun. 8, 2004.

Office Action in co-pending U.S. Appl. No. 10/954,491 dated Jan. 24, 2006.

Office Action in co-pending U.S. Appl. No. 10/954,491 dated Sep. 2, 2005.

Office Action in co-pending U.S. Appl. No. 10/954,491 dated Feb. 23, 2007.

* cited by examiner

CABLE CONNECTOR

This application claims priority from Japanese Patent Application Nos. 2005-199018 filed Jul. 7, 2005 and 2006-163733 filed Jun. 13, 2006, which are incorporated hereinto by reference.

BACKGROUND OF THE INVENTION

1. Field of the Invention

The present invention relates to a cable connector for electrically connecting one ends of cables to a wiring board.

2. Description of the Related Art

A cable connector is used in practice for electrically connecting electric parts with each other in the interior of an electronic apparatus. For example, the electric parts are electrically connected to a printed circuit board via a flexible printed circuit board (FPC) or a flexible flat cable (FFC). There are a rotary type and a slide type in the cable connector used in practice, which are different in a method for fixing a cable. As disclosed in Japanese Patent Application Laid-open No. 2001-357920, Japanese Patent Nos. 3579827 and 2692055 and Japanese Patent Application Laid-open No. 2002-289284, the rotary type cable connector includes a connector body disposed on a printed circuit board and having a cable accommodating section, a plurality of contact terminals provided in the cable accommodating section of the connector body, for electrically connecting an electrode part of the printed circuit board to a terminal section of a flexible printed circuit board, and an actuator member supported in a rotatable manner relative to the connector body, to be attachable to and/or detachable from contact points in the contact terminals of the terminal section in the flexible printed circuit board.

The connector body has, at one end thereof, an inserting port for allowing the terminal section of the flexible printed circuit board to be connected thereto. The inserting port is communicated to a cable accommodating section formed in the interior of the connector body. In a cut portion forming a top of the cable accommodating section in the connector body, opposite ends of a proximal part of the actuator member are supported in a rotatable manner. The actuator member occupies either a locked state in which the terminal section of the flexible printed circuit board is sandwiched between a pressing surface and a movable terminal section of the respective contact terminal at a predetermined position or an unlocked state in which the terminal section of the flexible printed circuit board is released. In the locked state, a site of action of the actuator member is closer to the terminal section of the flexible printed circuit board and generally parallel thereto. On the other hand, in the unlocked state, the actuator member opens the cut portion on the top of the cable accommodating section so that the site of action of the actuating member is separated from the flexible printed circuit board to intersect with a plane in which the terminal section of the circuit board is formed to be rotatable until the site of action abuts to a wall surface forming the above-mentioned cut portion of the connector body. Accordingly, to attach or detach the flexible printed circuit board when the actuator member is in the unlocked state, it is desired that the rotational angle of the actuator member is determined to be relatively large to obtain a large opening of the above-mentioned inserting port so that the attachment/detachment of the flexible printed circuit board becomes easier.

The actuator member has a pressing surface for pushing a back surface of the flexible printed circuit board toward the contact points of the contact terminals described later, while bringing the latter into contact with an end of a part of the actuator member opposed to the cable accommodating section.

A plurality of contact terminals are arranged in the cable accommodating section in correspondence to the arrangement of the terminal section in the electrode part of the flexible printed circuit board. Each of these contact terminals includes a fixed terminal portion soldered to the terminal portion of the printed circuit board, a fixed portion, a movable terminal portion, and a coupling portion for connecting the fixed terminal portion to the fixed portion and the movable terminal portion.

A front end of the fixed portion of the respective contact terminal is arranged to be opposed to a concavity formed in the actuator member. The movable terminal portion has, at its front end, a contact point to be electrically connected to the electrode section of the flexible printed circuit board.

A coupling section thereof is-fixed to the connector body by being press-fit to a slit formed adjacent to a cable accommodating section.

In such a structure, the terminal section of the flexible printed circuit board is electrically connected to the contact point of the respective contact terminal in the following manner. After the terminal section of the flexible printed circuit board is inserted into a position in the vicinity of a rear wall defining a rear side of the cable accommodating section through an inserting port, a front end of the actuator member is made to rotate such that a predetermined locked state is obtained. Accordingly, the terminal section of the flexible printed circuit board contacts the contact terminal of the movable terminal portion in the contact terminal and is held there, creating a reliabel electric connection. At that time, the terminal section of the flexible printed circuit board is sandwiched between the pressing surface of the actuator member and the elastically deformed movable terminal portion of the respective contact terminal.

SUMMARY OF THE INVENTION

When the terminal section on one side of the flexible printed circuit board is connected to the cable connector and the terminal section on the other side of the flexible printed circuit board is connected to electric equipment movably disposed in the interior of the electronic apparatus, a bending moment or a pulling force larger than a predetermined value may be applied to the terminal section on the one side of the flexible circuit board. The repeated reciprocation of the electric equipment, for example, may cause such a load. Consequently, the actuator member may be transferred from the locked state to the unlocked state such that the terminal section of the cable connector on the one side of the flexible printed circuit board comes off of the cable connector.

While taking the above-mentioned problems into account, an object of the present invention is to provide a cable connector for electrically connecting one end of a cable to a circuit board so that a terminal section of a flexible printed circuit board does not come off of the cable connector even if a pulling force or a bending moment larger than a predetermined value is applied to the terminal section on one side of the flexible printed circuit board, while ensuring sufficient opening of an inserting port.

To achieve the above-mentioned object, the inventive cable connector comprises a cable accommodating section for accommodating one end of a cable, having contact terminals to be electrically connected to a terminal section of the cable and a positioning portion for positioning the cable terminal section relative to the contact terminals, the cable accommodating section communicating with an opening for allowing the cable terminal section to pass therethrough, and an actuator member disposed in the cable accommodating section for rotating movement. The acutator member has a pressing portion in correspondence to the respective contact terminal, the pressing portion comprising a flat surface and a pressing surface for locking or unlocking an electrode section of the cable terminal section relative to a movable contact part of the respective contact terminal. The pressing portion of the actuator member is movably supported by a fixed portion of the contact terminal. Preferably, the fixed portion of the contact terminal includes an angled (or slanted) portion formed continuous with a concavity allowing the fixed portion of the contact terminal to support the actuator member. The fixed portion of the contact terminal preferably formed opposite the movable contact part of the contact terminal at a predetermined distance. When the actuator member is in a locked state, a position of a site of action in the pressing surface of the actuator member relative to the cable terminal section is nearer to the positioning portion in the cable accommodating section than to a position of the movable contact part.

The inventive cable connector may also comprise a cable accommodating section for accommodating one end of a cable, having contact terminals to be electrically connected to a terminal section of the cable and a positioning portion for positioning the cable terminal section relative to the contact terminals, the cable accommodating section communicating to an opening for allowing the cable terminal section to pass therethrough; and an actuator member disposed in the cable accommodating section for rotating movement. The acutator member preferably comprises a pressing portion in correspondence to the respective contact terminal, the pressing portion comprising a flat surface and a pressing surface for locking or unlocking an electrode section of the cable terminal section inserted into the cable accommodating section relative to a movable contact part of the respective contact terminal.

In such a configuration, the relative position of the center of rotation of the pressing portion of the the actuator member relative to an engagement part of a fixed portion of the contact terminal moves as the actuator member rotates.

As apparent from the above description, according to the inventive cable connector, the respective pressing portion of the actuator member is movably supported on the slant surface consecutive to the concavity formed in the fixed portion opposite the movable contact part of the respective contact terminal at a predetermined gap. Thereby, since a position of the operating portion of the pressing surface of the actuator member is nearer to the inner wall in the cable accommodating section than the movable contact part, a terminal section of a flexible printed circuit board does not come off from the cable connector even if a pulling force or a bending moment larger than a predetermined value is applied to the terminal section on one side of the flexible printed circuit board, while ensuring a sufficient opening of an inserting port.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Figure 3:
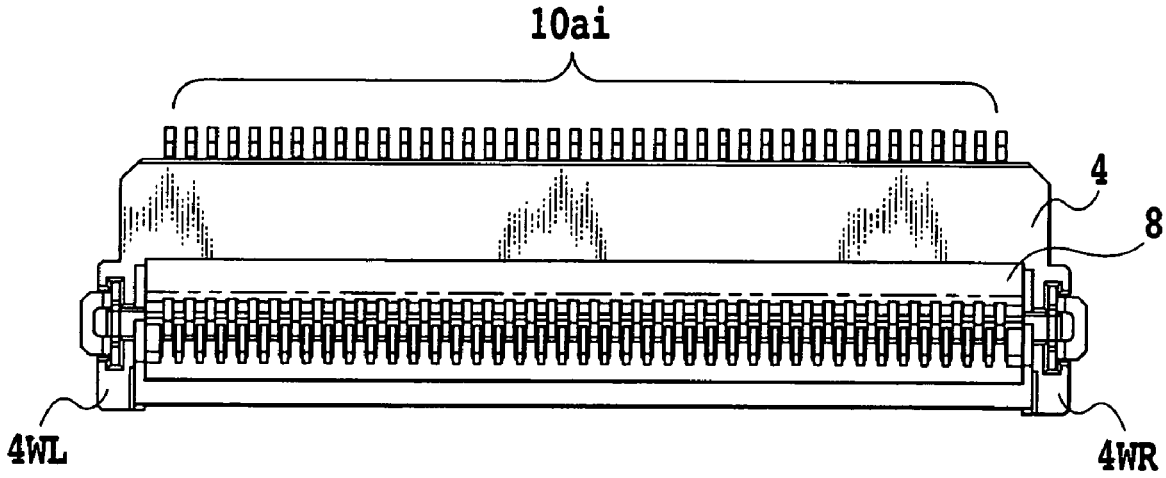
FIG. 3 is a plan view of the embodiment shown in FIG. 2.
Figure 4:
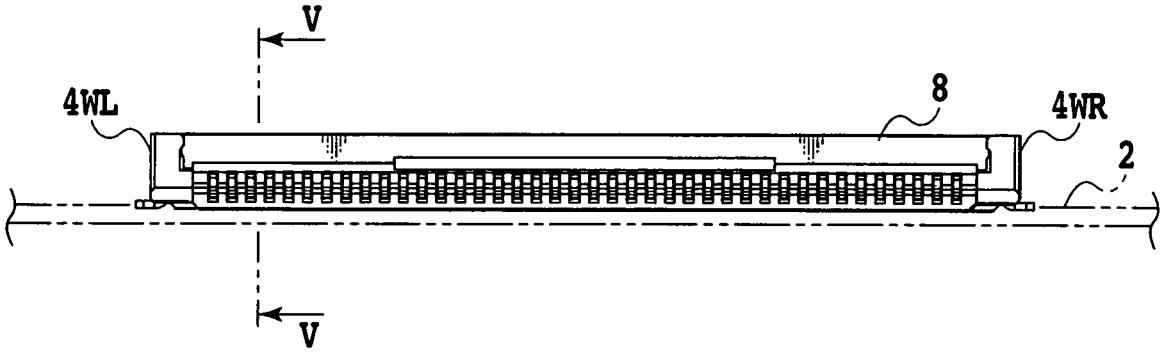
FIG. 4 is a front view of the embodiment shown in FIG. 2.

FIGS. 3 and 4 illustrate an appearance of one embodiment of the inventive cable connector.

In FIG. 3, the cable connector includes a connector body 4 having a cable accommodating section 4A, arranged on a printed circuit board 2, a plurality of contact terminals 10*ai* (i=2 to n, n is an positive integer) (see FIG. 6) provided in the cable accommodating section 4A (see FIG. 5) in the connector body 4, for electrically connecting an electrode parts of the terminal section in the flexible printed circuit board 2, and an actuator member 8 supported in a rotatable manner to opposite lateral walls 4WR and 4WL of the connector body 4, for fixing or releasing the terminal section in the flexible printed circuit board 6 to the contact terminals 10*ai*.

The flexible printed circuit board 6 is referred, for example, to YFLEX (registered trade mark) and has a structure wherein a plurality of conductive layers, each covered with a protective layer are formed on an insulative substrate. The insulative substrate is molded with one material suitably selected from a group consisting of glass-epoxy resin, polyimide (PI), polyethylene terephthalate (PET) and polyether-imide (PEI) of approximately 50 μm thick. Also, the conductive layer is formed, for example, of a copper alloy of approximately 12 μm thick. The protective layer is formed, for example, of a thermosetting type resist layer or polyimide film.

A back board 6B is provided on one surface of an end to be connected in the flexible printed circuit board 6. The back plate 6B is formed, for example, of polyethylene terephthalate (PBT) to have a predetermined thickness. In this regard, the back plate 6B may have an operation part for facilitating the attachment/detachment of the flexible printed circuit board.

On the other surface of the end of the flexible printed circuit board 6 (opposite to the back plate 6B), a group 6E of a plurality of electrodes, each having a width of 0.3 mm, is formed as the terminal section. The adjacent electrodes are formed to have a mutual space, for example, of approximately 0.5 mm. The electrode group 6E is electrically connected to a conductive layer in the interior of the flexible printed circuit board 6.

Figure 2:
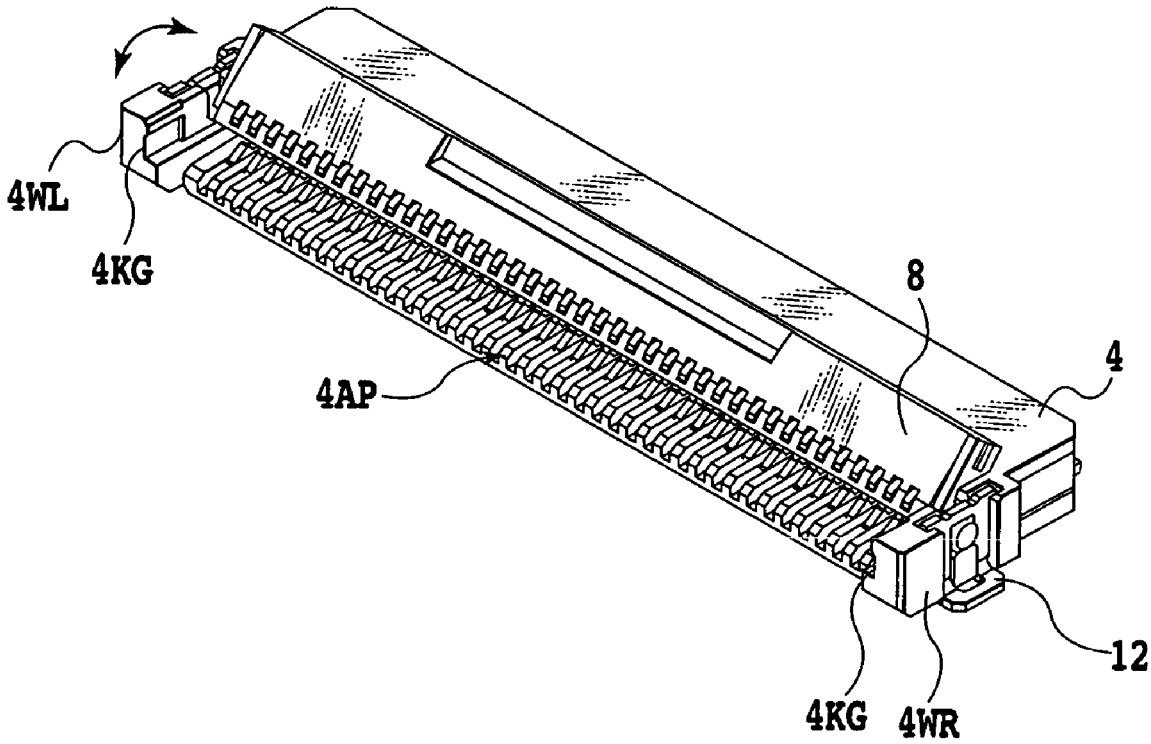
FIG. 2 is a perspective view of an appearance of the embodiment of the cable connector according to the present invention.
Figure 6:
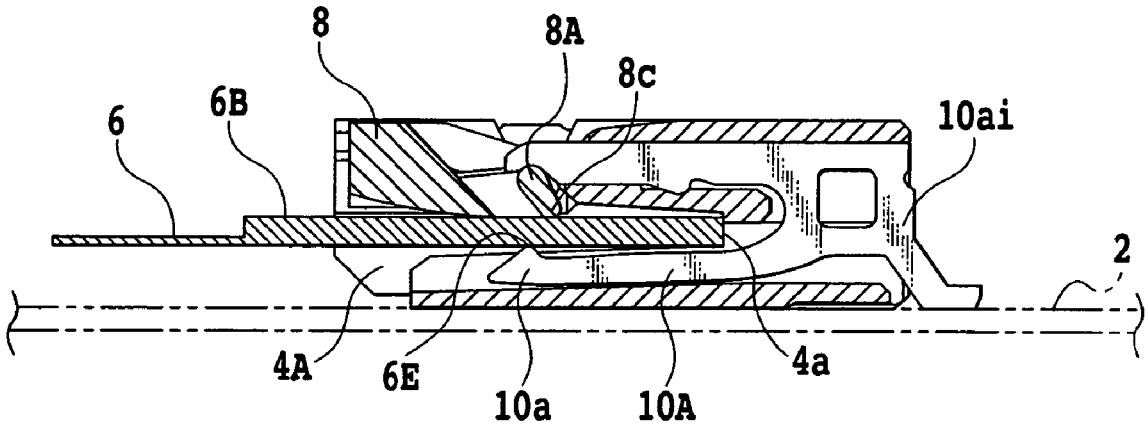
FIG. 6 is a cross-sectional view illustrating a state wherein one end of a flexible printed circuit board is connected in FIG. 5.

The cable accommodating section 4A in the connector body 4 molded with resin has an opening 4AP at one end for allowing the electrode group 6E and the back plate 6B of the flexible printed circuit board 6 to pass therethrough as shown in FIGS. 2 and 6. At the other end on the inside of the cable accommodating section 4A, an inner wall 4*a* is formed, to which abuts an end surface of the inserted back plate 6B of the flexible printed circuit board 6 and is positioned to a contact point section 10*a* of the electrode group 6E. While the positioning of the electrode group 6E to the contact point section 10*a* is carried out by the inner wall 4*a* in this embodiment, the present invention should not be limited thereto but a positioning member other than the inner wall may be provided on the inside of the cable accommodating section 4A.

As shown in FIG. 2, on the inside of the lateral walls 4WR and 4WL formed on opposite ends of the opening 4AP, guide grooves 4KG are formed for guiding lateral sides of the back plate 6B in the flexible printed circuit board 6.

Figure 7:
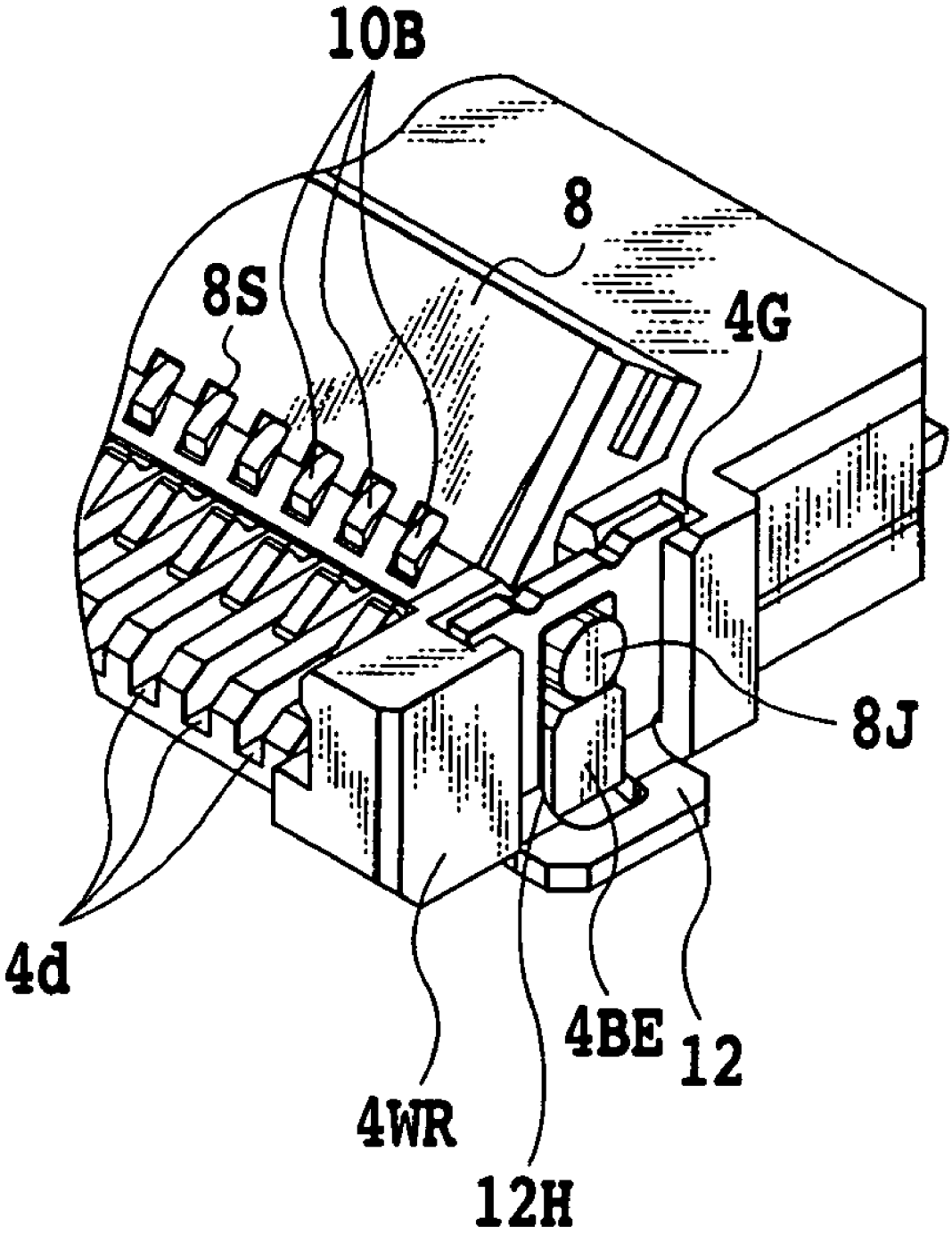
FIG. 7 is an enlarged perspective view of part of a connector body shown in FIG. 2.
Figure 8:
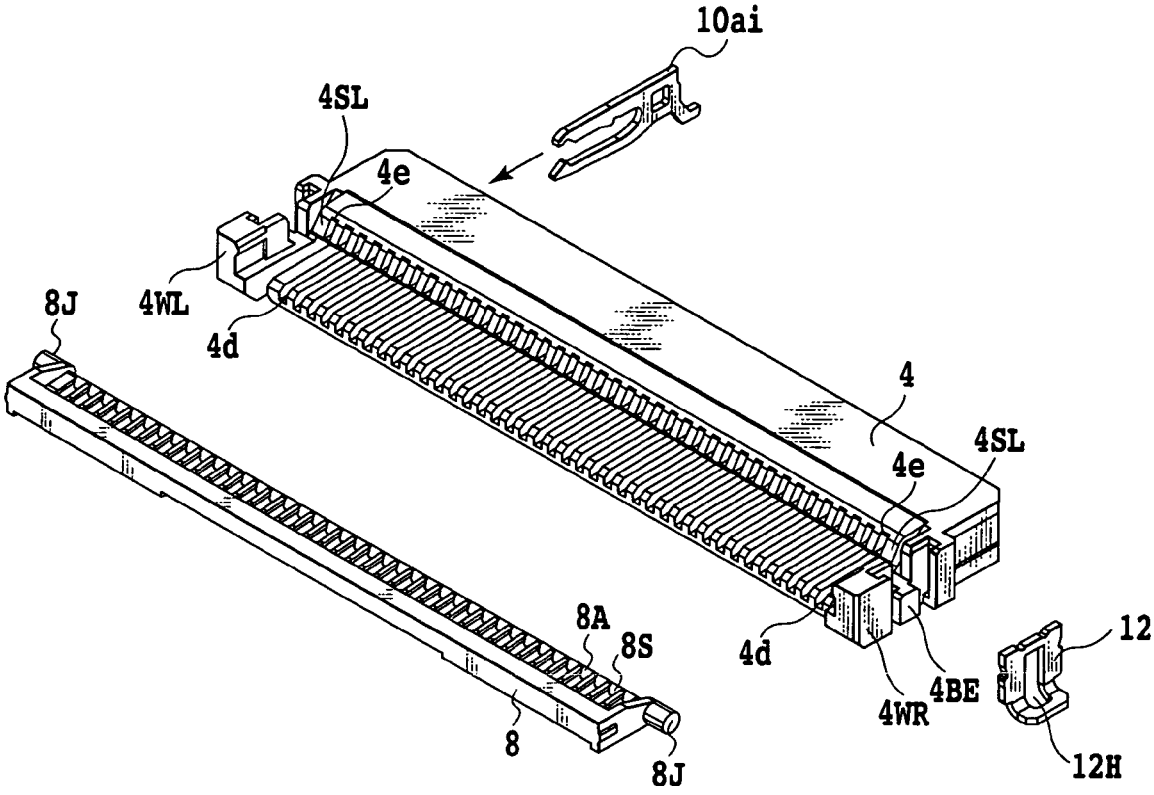
FIG. 8 is an exploded perspective view of a cable connector shown in FIG. 2.

As shown in FIG. 8, each of the lateral walls 4WR and 4WL has a notch into which a supporting shaft 8J is inserted in a rotatable manner, formed at the respective end of the actuator member 8. On the inside of the notch, a bearing 4BE is formed for receiving the supporting shaft. As shown in FIG. 7 in enlarged dimension, the periphery of the notch has a groove 4G a fastening member 12 for holding the supporting shaft 8J in the bearing 4BE in a rotatable manner is inserted into the groove 4G. The fastening member 12 has a hole 12H into which is inserted an end of the supporting shaft 8J to be restricted thereby.

Figure 1:
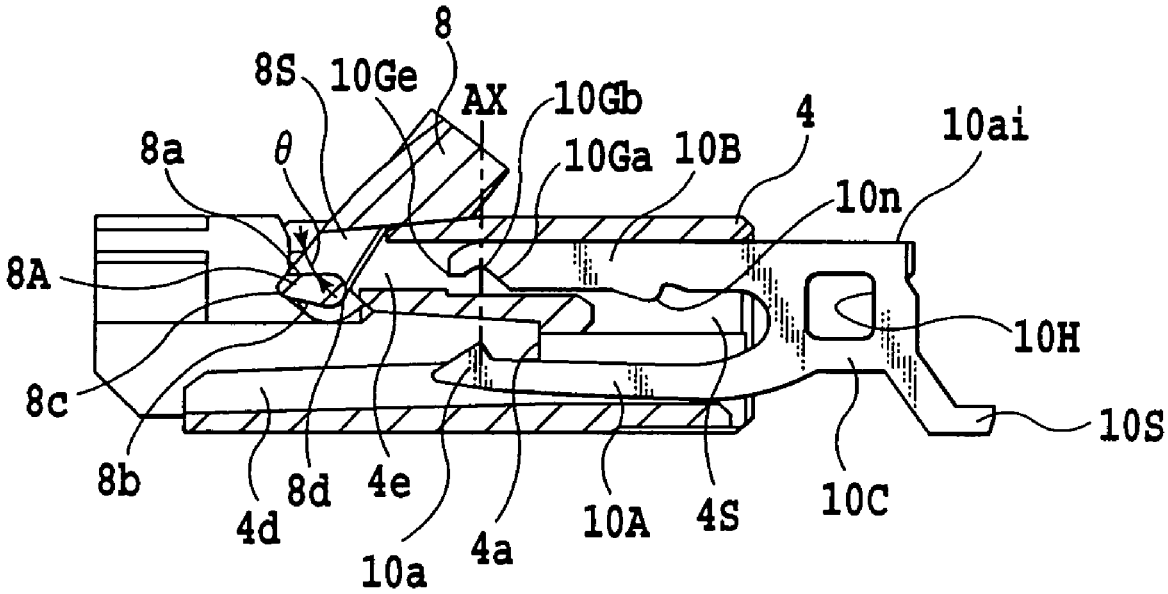
FIG. 1 is a cross-sectional view of a main part of one embodiment of a cable connector according to the present invention.
Figure 5:
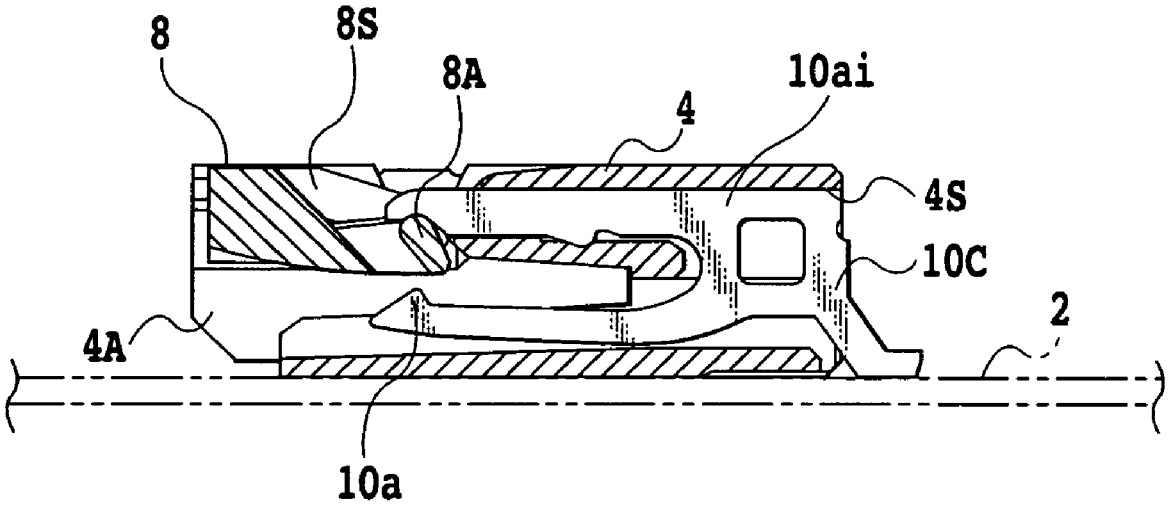
FIG. 5 is a cross-sectional view taken along a line V-V in FIG. 4.

As shown in FIG. 5, in a wall forming a back surface of the connector body 4, a plurality of slits 4S are formed into which are press-fit coupling parts 10C of the respective contact terminals 10*ai*. The respective slit is formed at a predetermined mutual pitch along a longitudinal direction of the connector body 4 and communicates with the interior of the cable accommodating section 4A. The slit 4S is bifurcated into a slit 4*e* and a slit 4*d* by a partition wall formed generally parallel to a bottom wall thereof at a point in front of the cable accommodating section 4A as shown in FIG. 1. A movable terminal portion 10A of the contact terminal 10*ai* is inserted into the slit 4*d* and a fixing part 10B of the contact terminal 10*ai* is inserted into the slit 4*e*. In a part forming an upper edge of the opening 4AP to which opens one end of the slit 4*e*, a slant 4SL is formed, which obliquely abuts a surface of the actuator member 8 when the actuator member 8 is in a released state as described later (see,for example, FIG 8).

As shown in FIG. 1 in enlarged dimension, the contact terminal 10*ai* arranged in the cable accommodating section 4A in correspondence to the arrangement of the electrode in the electrode group 6E of the flexible printed circuit board 6 includes a soldered fixing part 10S to be electrically connected to an electrode pad as a conductive layer of the printed circuit board 2 by soldering, a movable contact part 10A having a contact 10*a* to be electrically connected to the electrode group 6E of the flexible printed circuit board 6, a fixing part 10B press-fitted in the slit 4*e* of the connector body 4, the fixing part having an engagement part for supporting a pressing portion 8A of an actuator 8 for rotating movement described later, and a coupling part 10C for coupling a merging portion of the movable contact part 10A and the fixing part 10B to the soldered fixing part 10S.

The movable contact part 10A and the fixing part 10B made of a thin metallic plate are bifurcated. In a portion of the fixing part 10B opposed to the contact point section 10*a* of the movable contact part 10A, an engagement part for supporting the pressing portion 8A of the actuator 8 described later for rotating movement is formed.

As shown in FIG. 1 in enlarged dimension, the engagement part is defined by a flat surface portion 10Ge formed at a front end of the fixing part 10B, an arc-shaped portion 10Gb continued to the flat surface portion 10Ge, and a slant part 10Ga continued to the arc-shaped portion 10Gb and having a predetermined inclination. The flat surface portion 10Ge is formed at a position through which passes a flat surface 8*a* of the pressing portion 8A in the actuator 8 described later. The arc-shaped portion 10Gb is formed so that a straight line AX passing a center of curvature of the arc-shaped portion also passes the contact point section 10*a* positioned directly beneath the same in the FIG. 1.

A nib 10*n* engageable with the partition wall when being press-fit is formed between a portion coupled to the coupling part 10C and the engagement portion in the fixing part 10B.

A generally square opening 10H is formed in the coupling part 10C. The opening 10H is provided for reducing a capacitance between the adjacent contact terminals 10*ai*. That is, when the opening 10H is provided, an overlapped common area between the contact terminals 10*ai* disposed adjacent to each other becomes smaller in comparison with a case wherein the opening 10H is not provided, resulting in the reduction of capacitance between the parallel surfaces of the adjacent contact terminals 10*ai*.

Figure 17:
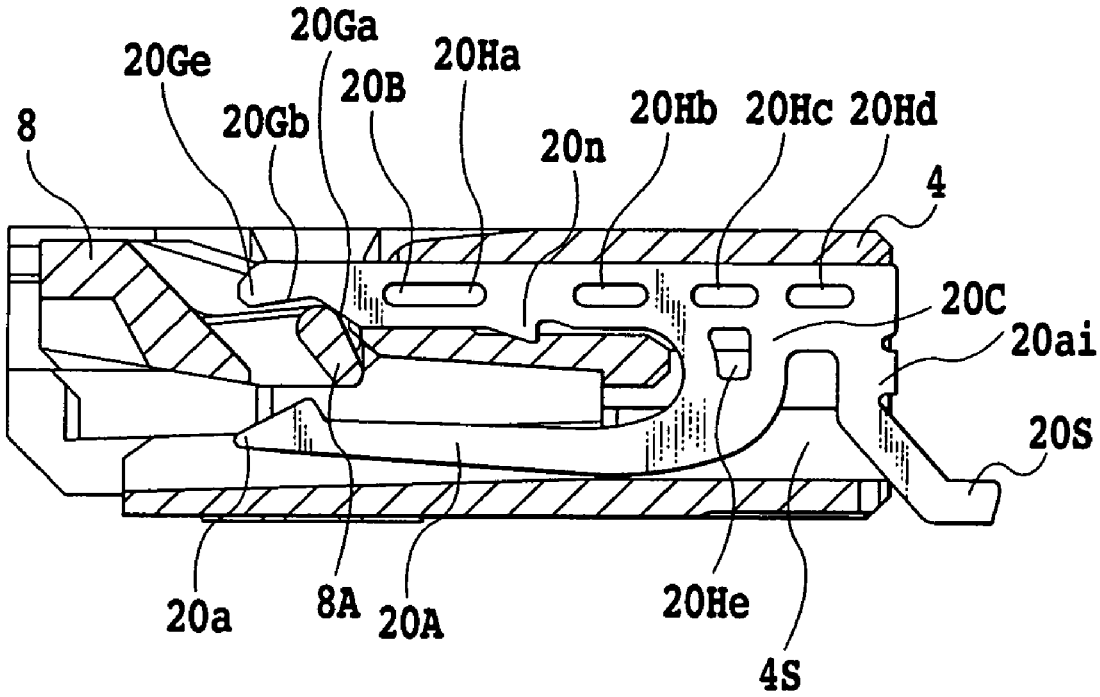
FIG. 17 is a cross-sectional view of an another contact terminal used in one embodiment of the inventive cable connector together with a socket body.

In this regard, a shape of the contact terminal 10*ai* is not limited to this example, but a contact terminal 20*ai* having a shape shown in FIG. 17 may be used, for example.

The contact terminal 20*ai* includes a soldered fixed portion 20S to be electrically connected by soldering to an electrode pad used as a conductive layer of the printed circuit board 2, a movable contact portion 20A having a contact point 20*a* to be electrically connected the electrode group 6E of the flexible printed circuit board 6, a fixed portion 20B having an engagement part to be press-fit into a slit 4*e* of the connector body 4, the fixed portion for supporting a pressing portion 8A of the actuator 8 described later for rotating movement, and a coupling portion 20C for coupling a merging point of the movable contact portion 20A and the fixed potion 20B to the soldered fixed portion 20S. In FIG. 17, only one contact terminals 20*ai* in a plurality thereof is illustrated.

The movable contact portion 20A and the fixed portion 20B are formed from a thin metallic plate. In a region of the fixed portion 20B opposed to the contact point 20*a* of the movable contact portion 20A, an engagement part for supporting the pressing portion 8A of the actuator 8 for rotating movement is formed.

The engagement part is defined by a flat surface portion 20Ge formed at a front end of the fixed portion 20B, an arc-shaped portion 20Gb continued to the flat surface portion 20Ge, and a slant portion 20Ga continued to the arc-shaped portion 20Gb and having a predetermined inclination. The flat surface portion 20Ge is formed at a position through which the flat surface 8*a* of the pressing portion 8A of the actuator 8 described later passes. A length of the flat surface portion 20Ge extending from an end of the arc-shaped portion 20Gb is longer than the corresponding length in the above-mentioned contact terminal 10*ai*. Thereby, when the flexible printed circuit board 6 is mounted, the engagement of the respective pressing portion of the actuator 8 to the engagement part thereof is more ensured as a whole.

The arc-shaped portion 20Gb is formed so that, in FIG. 17, a straight line passing through the center of curvature thereof also passes through the contact point 20*a* located directly beneath the center of curvature.

A nib 20*n* engageable with a partition wall when press-fit is formed between a region coupled to the coupling portion 20C and the engagement part in the fixed portion 20B.

A plurality of openings 20Ha, 20Hb, 20Hc, 20Hd and 20He are formed in the coupling portion 20C and the fixed portion 20B. The openings 20Ha to 20He are provided for reducing capacitance between the adjacent contact terminals 20*ai*. That is, when the openings 20Ha to 20He are provided, an overlapped common area between the contact terminals 20*ai* disposed adjacent to each other becomes smaller in comparison with a case wherein the openings 20Ha to 20He are not provided, resulting in the reduction of capacitance between the parallel surfaces of the adjacent contact terminals 20*ai*.

In an intermediate region of the actuator member 8 molded, for example, of resin, as shown in FIG. 8, a plurality of slits 8S are arranged in the longitudinal direction opposite to the respective slits 4*e* in the connector body 4. Every adjacent slits 8S are sectioned by a partition wall. Within the slit 8S, a pressing portion 8A for coupling the adjacent partition walls is provided. As shown in FIG. 1, the outer circumference of the pressing portion 8A is defined by flat surfaces 8*a* and 8*b* formed opposite to each other, a pressing surface 8*c* for pressing the back plate 6B of the flexible printed circuit board 6 when the actuator member 8 is in a locked state, an arc-shaped portion 10Gb of the above-mentioned contact terminal 10*ai*, and a sliding surface 8*d* continued to the arc-shaped portion 10Gb and engageable with the slant part 10Ga having a predetermined inclination. In FIG. 1, the pressing portion 8A is formed so that the flat surfaces 8*a* and 8*b* make a predetermined angle θ relative to an outer surface of the actuator member 8.

At opposite ends the actuator member 8 as seen in the direction vertical to the arrangement of the slits 8S, the supporting shafts 8J to be rotatably supported by bearings 4BE of the above-mentioned connector body 4 are formed. The supporting shafts 8J are formed integral with the pressing portion 8A on a common central axis thereof on one side of a short side of the actuator member 8. Also, the supporting shaft 8J is placed on the bearing 4BE and rotatably inserted into a hole 12H of the fastening member 12.

On the other end of the short side of the actuator member 8, an operating part for coupling the respective short sides of the actuator member 8 extends in the longitudinal direction of the actuator member 8.

Thereby, the actuator member 8 supported rotatably via the bearings 4BE of the connector body 4 occupies a locked position wherein the terminal section of the flexible printed circuit board 6 is pinched between the pressing surface 8*c* and the movable terminal portion 10A of the respective contact terminal 10*ai* as shown in FIG. 6, and an unlocked position wherein the terminal section of the flexible printed circuit board 6 is released as shown in FIG. 2. That is, in the locked position, the actuator member 8 is generally parallel to the terminal section of the flexible printed circuit board 6, and in the unlocked position, the actuator member 8 opens the opening 4AP of the cable accommodating section 4A, intersects with a surface on which the terminal section of the flexible printed circuit board 6 is formed, and is rotational moveable until it is brought into contact with the slant 4SL of the connector body 4.

Figure 10A:
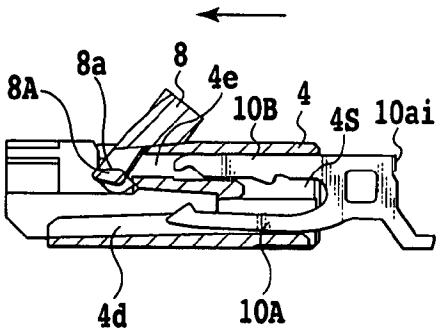
FIGS. 10A, 10B, 10C and 10D are cross-sectional views, respectively, made available for explaining the assembly procedures of a contact terminal and an actuator member.
Figure 10B:
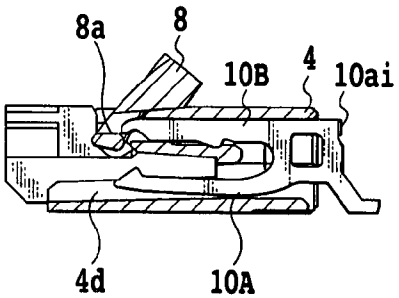

According to a first method for assembling the actuator member 8 and the plurality of contact terminals 10*ai* in predetermined positions of the connector body 4, after the supporting shafts 8J of the actuator member 8 are placed on the bearings 4BE, the outer periphery of the fastening member 12 is first inserted into the groove 4G. Then, after the actuator member 8 is located at the above-mentioned unlocked position (see FIG. 2), the contact terminal 10*ai* is press-fit into the interior of the connector body 4 in the direction indicated by an arrow in FIG. 10A via the slit 4S while front ends of the movable contact terminal portion 10A and the fixed portion 10B are at the head thereof. At that time, as shown in FIG. 10B, the flat surfaces 8*a* and 8*b* of the pressing portion 8A in the actuator member 8 are arranged in a plane common to the flat surface portion 10Ge of the contact terminal 10 *ai*.

Figure 10C:
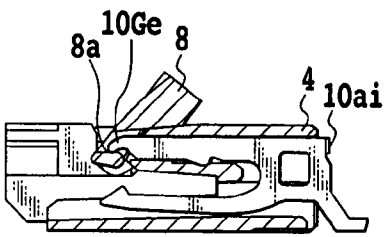
Figure 10D:
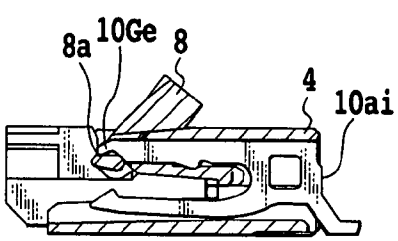

Subsequently, as shown in FIG. 10C, the flat surface portion 10Ge of the contact terminal 19*ai* is further press-fitted in the same direction. At that time, since there is the arc-shaped portion 10Gb of the contact terminal 10*ai* functioning also as a play for avoiding the interference, the engagement is smoothly carried out without being interfered with the flat surface 8*a* of the pressing portion 8A in the actuator member 8. And, as shown in FIG. 10D, the flat surface portion 10Ge of the contact terminal 10*ai* is further pushed in the connector body 4 in the same direction until the sliding surface 8*d* touches to the slant part 10Ga, whereby the attachment of the contact terminal 10*ai* to the connector body 4 is completed. Accordingly, when the contact terminal 10*ai* is attached to the connector body 4, there is no risk in that the pressing portion 8A of the actuator member 8 is excessively scraped by the front end of the contact terminal 10*ai*.

Figure 11:
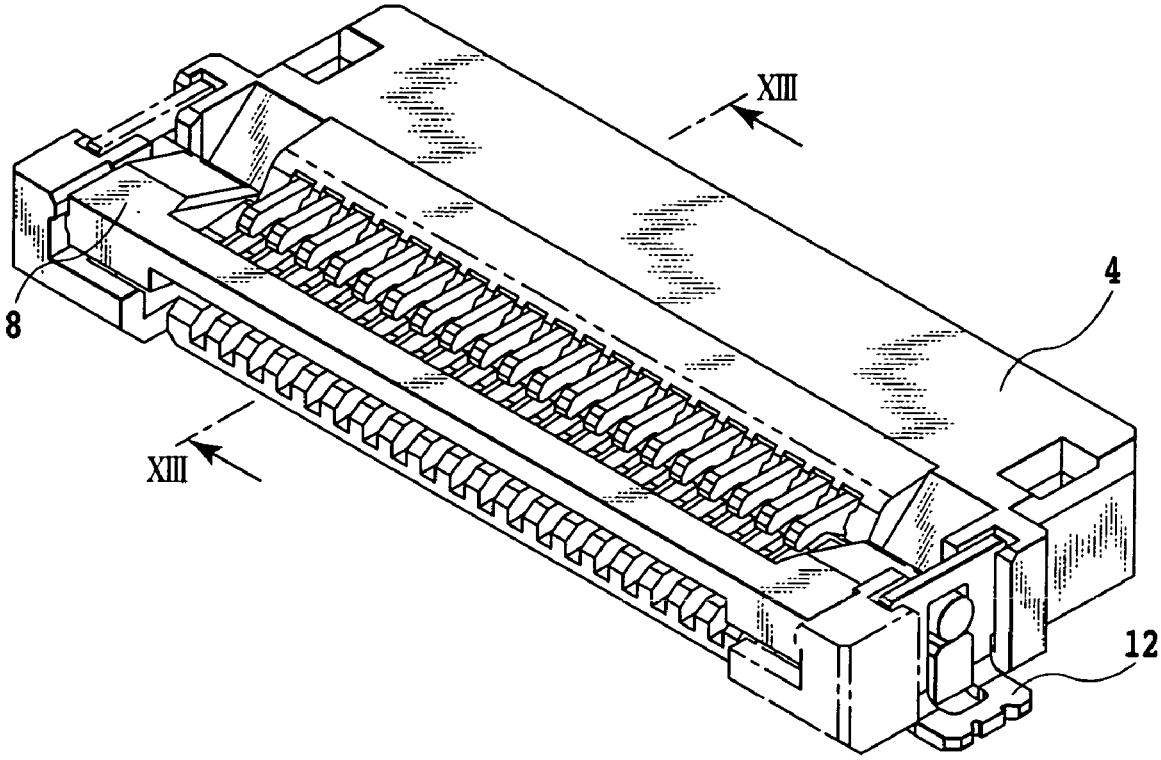
FIG. 11 is a perspective view made available for explaining the operations of the embodiment shown in FIG. 2.
Figure 12:
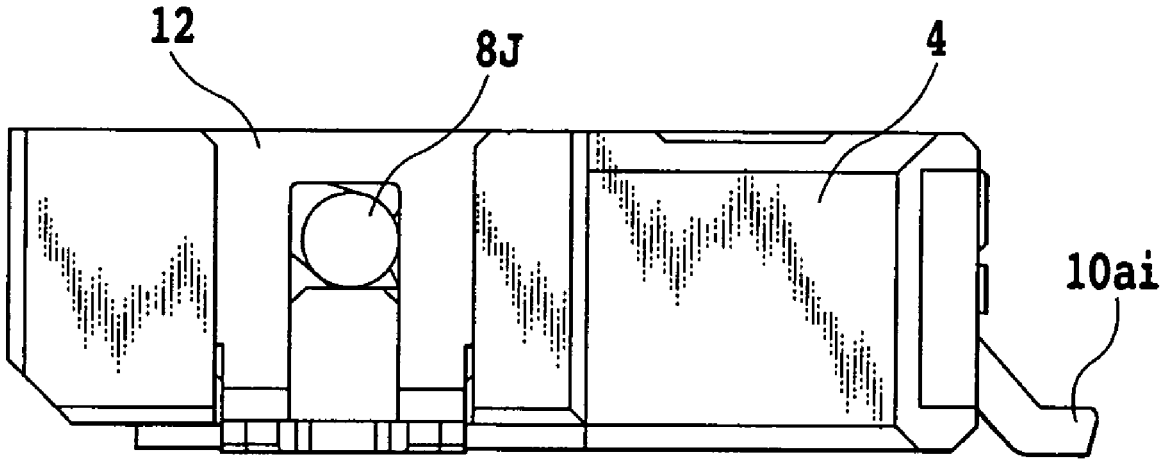
FIG. 12 is a side view illustrating a socket body in a state shown in FIG. 11.
Figure 14:
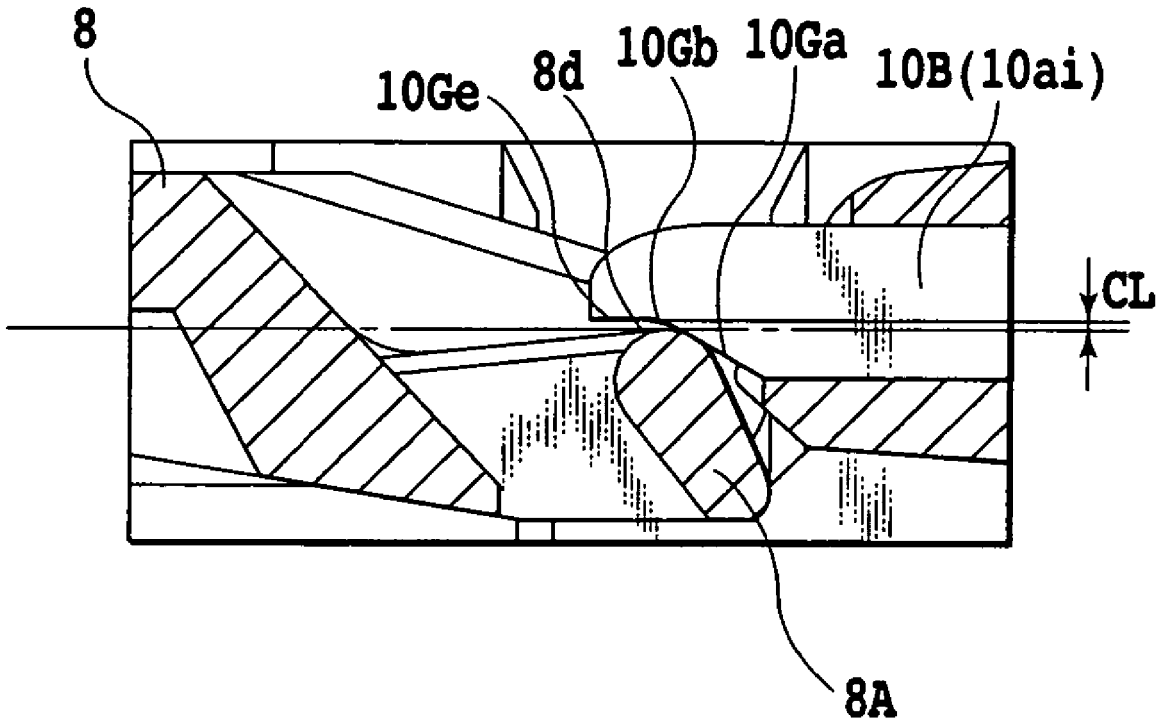
FIG. 14 is a partial enlarged view of FIG. 13.
Figure 15A:
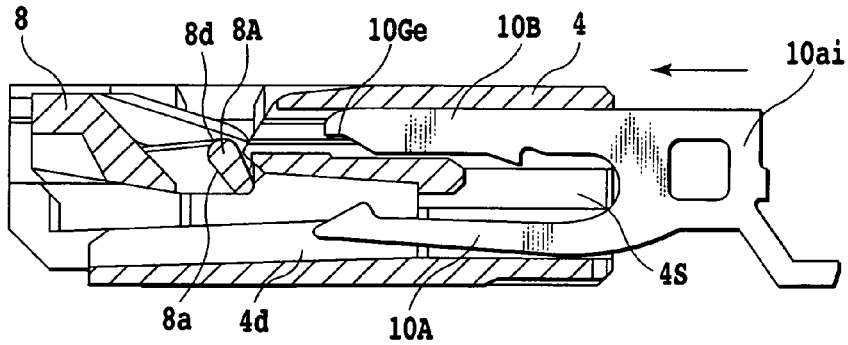
FIGS. 15A, 15B, 15C and 15D are cross-sectional views, respectively, made available for explaining an another assembly procedures of a contact terminal and an actuator member or others.
Figure 15B:
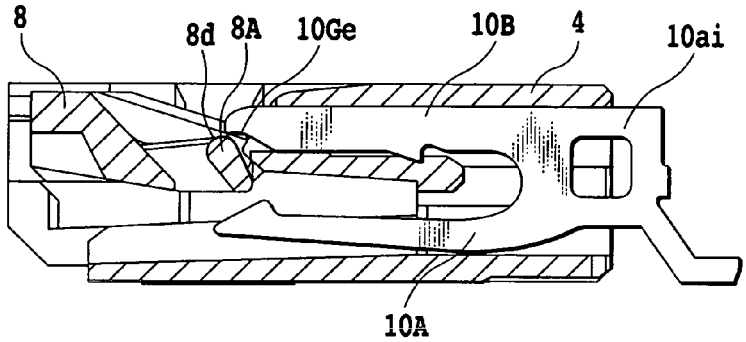

According to a second method for assembling the actuator member 8 and the plurality of contact terminals 10*ai* with predetermined positions of the connector body 4, as shown in FIGS. 15A to 15D, after the supporting shafts 8J of the actuator member 8 are placed on the bearings 4BE, the outer periphery of the fastening member 12 is first inserted into the groove 4G. Then, after the actuator member 8 is located at the above-mentioned locked position (see FIGS. 11 and 12), the contact terminal 10*ai* is press-fitted into the interior of the connector body 4 in the direction indicated by an arrow in FIG. 15A via the slit 4S while front ends of the movable contact terminal portion 10A and the fixed portion 10B are at the head thereof. At that time, as shown in FIG. 15B or FIG. 14 in enlarged dimension, a position of the sliding surface 8*d* of the pressing portion 8A in the actuator member 8 are set to have a predetermined gap CL from a plane common to the flat surfaces 10Ge of the contact terminal 10*ai*.

Figure 13:
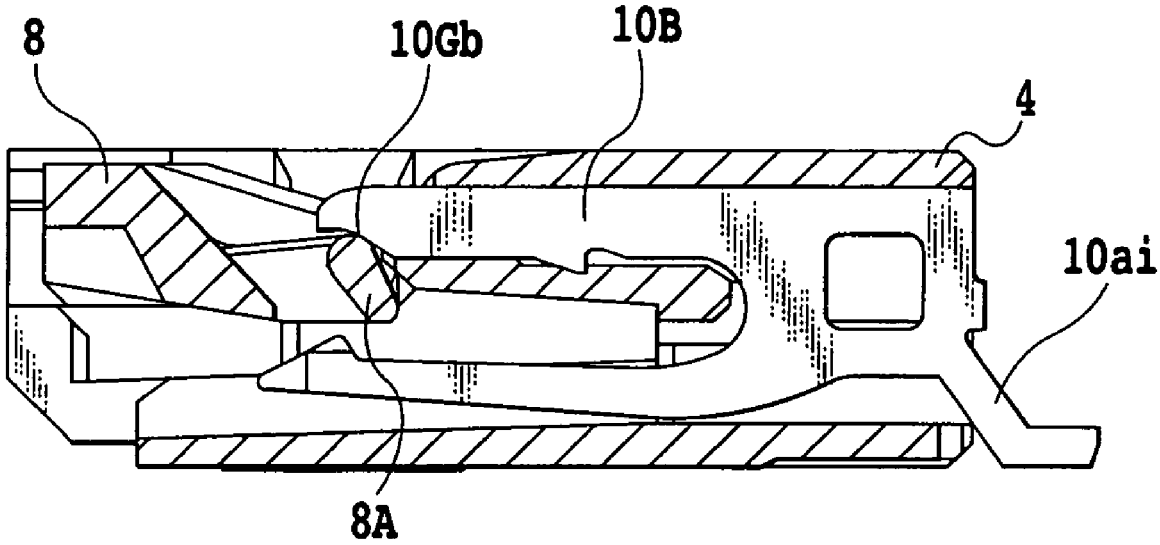
FIG. 13 is a cross-sectional view taken along a line XIII-XIII in FIG. 11.
Figure 15C:
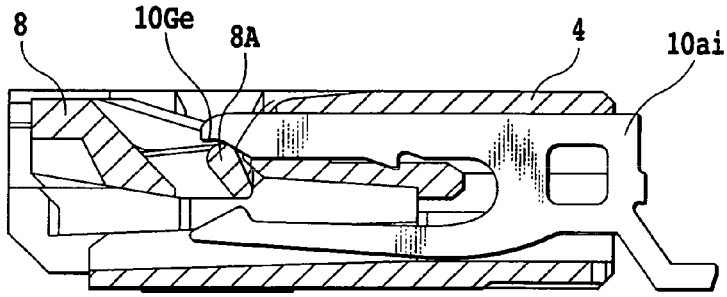
Figure 15D:
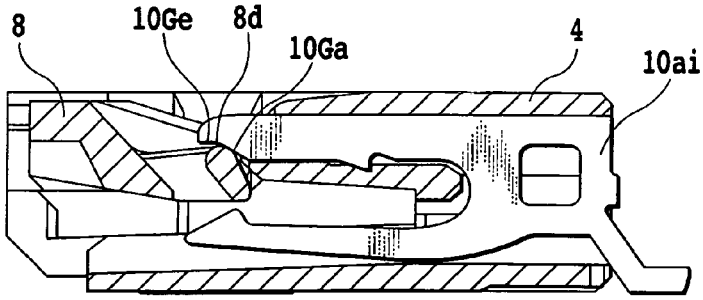

Subsequently, as shown in FIG. 15C, the flat surface portion 10Ge of the contact terminal 10*ai* is further press-fitted in the same direction. At that time, since there is the arc-shaped portion 10Gb of the contact terminal 10*ai* functioning also as a play for avoiding the interference, the engagement is smoothly carried out without being interfered with the pressing portion 8A in the actuator member 8. And, as shown in FIGS. 13 and 15D, the flat surface portion 10Ge of the contact terminal 10*ai* is further pushed into the connector body 4 in the same direction until the sliding surface 8*d* touches to the slant part 10Ga, whereby the attachment of the contact terminal 10*ai* to the connector body 4 is completed. Accordingly, in the same manner as in the above-mentioned first method, when the contact terminal 10*ai* is attached to the connector body 4, there is no risk in that the pressing portion 8A of the actuator member 8 is excessively scraped by the front end of the contact terminal 10*ai*. That is, even if the actuator member 8 is either in the unlocked position or in the locked position, it is possible to easily attach the contact terminal 10*ai* to the connector body 4.

Figure 9A:
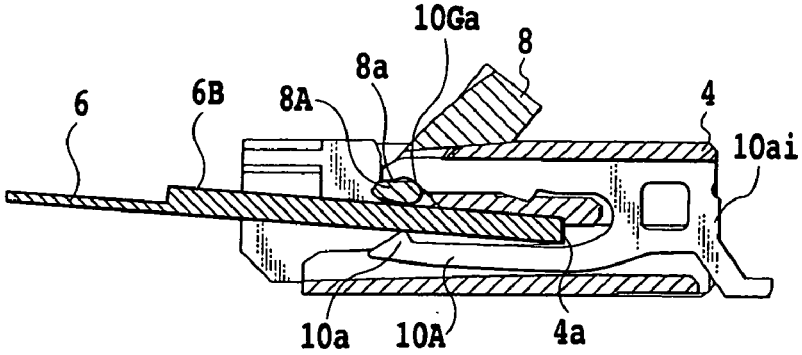
FIGS. 9A, 9B, 9C and 9D are cross-sectional views, respectively, made available for explaining the operations of the cable connector according to the present invention.
Figure 9B:
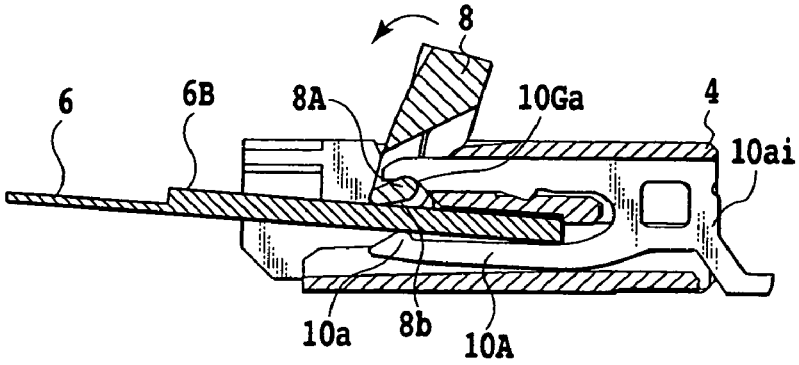
Figure 16A:
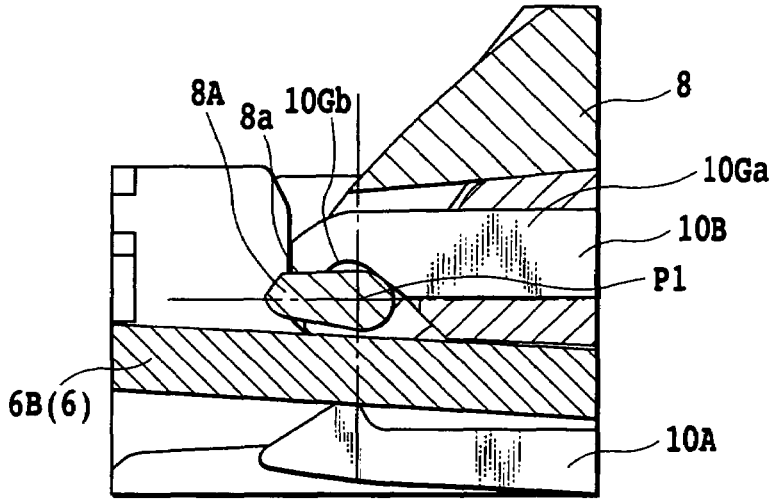
FIGS. 16A, 16B and 16C are partial enlarged cross-sectional views, respectively, made available for explaining the operations of one embodiment of the inventive cable connector.

In such a structure, when the group of the electrode 6E (the back plate 6B) of the flexible printed circuit board 6 to the respective contact terminal 10*ai*, as shown in FIGS. 9A and 16A, a front end of the back plate 6B of the flexible printed circuit board 6 is inserted into the opening 4AP while keeping the actuator member 8 in the unlocked state until it touches to the inner wall 4*a* forming the rear side of the cable accommodating section 4A. Thereafter, the operating part of the actuator member 8 is made to rotate counterclockwise as indicated by an arrow in FIG. 9B to move toward the locked state.

Figure 16B:
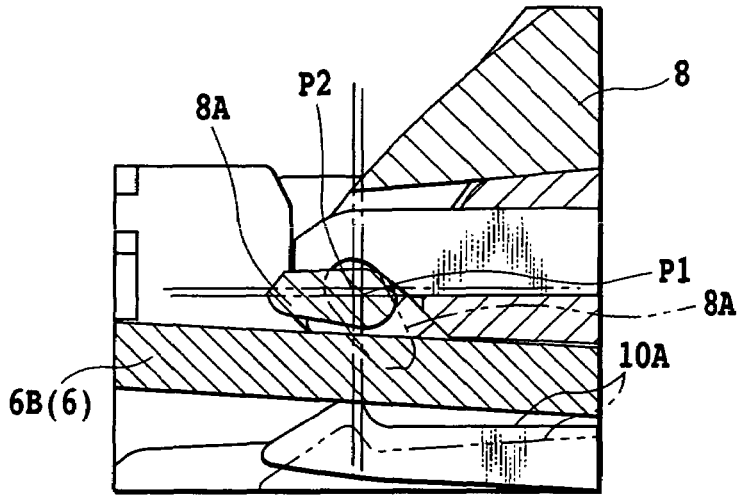

At that time, since the sliding surface 8*d* of the rotating actuator member 8 is guided while sliding along the slant part 10Ga of the contact terminal 10*ai*, the flat surface 8*b* of the pressing portion 8A is somewhat moved forward while rotating until it is brought into contact with the back plate 6B. Also, as shown in FIG. 16B, a relative position P1 of the center of rotation of the pressing portion 8A relative to the engagement part in the initial position begins to move along a predetermined locus toward a relative position P2 of the center of rotation relative to the engagement part upon the completion of rotation.

Figure 9C:
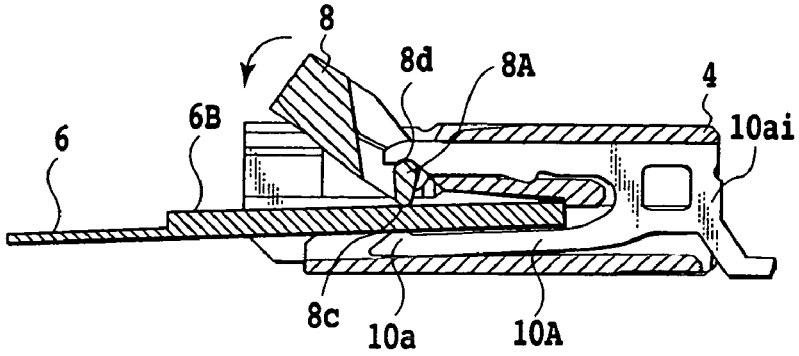
Figure 9D:
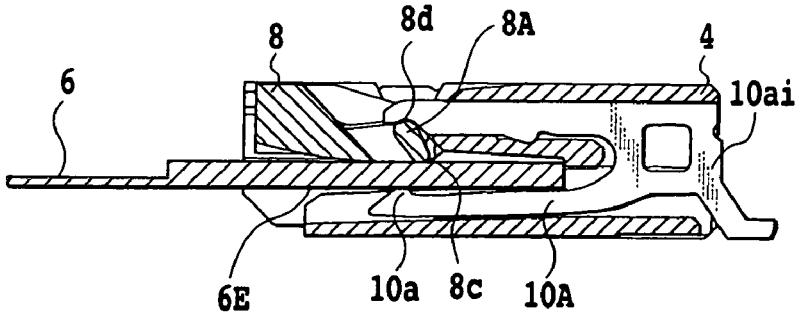
Figure 16C:
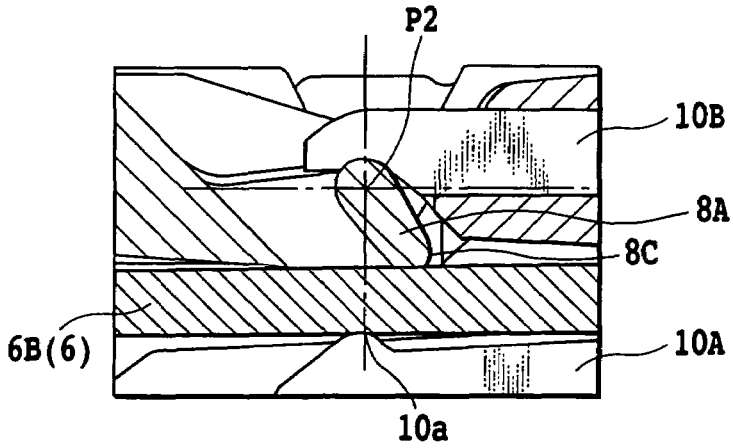

Next, as shown in FIG. 9C, the operating part of the actuator member 8 is made to further rotate in the same direction, and the pressing surface 8*c* thereof presses the back plate 6B downward, while rotating, toward the contact point section 10*a*. And, since the operating part of the actuator member 8 is further made to rotate until coming close to the surface of the back plate 6B as shown in FIGS. 9D and 16C, the sliding surface 8*d* is supported by the arc-shaped portion 10Gb and made to rotate to be in contact with the surface of the back plate 6B. Thereby, the pressing surface 8*c* further rotates via the back plate 6B to a position nearer to the inner wall 4*a* than a position of the contact point section 10*a* of the contact terminal 10*ai* disposed directly beneath the same, and made to stop there. At that time, the contact position between the pressing surface 8*c* and the back plate 6B is closer to the inner wall 4*a* than the relative positions P2 and P1 of the above-mentioned center of rotation of the pressing portion 8A relative to the engagement part.

Accordingly, the electrode group 6E in the flexible printed circuit board 6 is pressed to the contact point section 10*a* of the movable terminal portion 10A in the contact terminal 10*ai* by the pressing surface 8*c* of the actuator member 8, and held to be electrically connected thereto. The back plate 6B of the flexible printed circuit board 6 is pinched between the pressing surface 8*c* of the actuator member 8 and the elastically deformed movable terminal portion 10A of the respective contact terminal 10*ai*. At that time, since the center of rotation of the pressing portion 8A is located directly above the contact point section 10*a* of the contact terminal 10*ai* and the point of application on the pressing surface 8*c* is closer to the inner wall 4*a* than to the contact point section 10*a*, the clockwise rotation of the actuator member 8 is inhibited even if the pulling force or the bending moment is applied to the other end of the flexible printed circuit board 6. Thereby, there is no risk in that the one end of the flexible printed circuit board 6 is removed from the cable connector.

Further, since the relative position P1 of the center of rotation of the pressing portion 8A relative to the engagement part moves along the predetermined locus toward the relative position P2 which is the center of rotation thereof relative to the engagement part upon the completion of the rotation, it is possible to select a relatively large opening angle of the actuator member 8.

On the other hand, when the flexible printed circuit board 6 located as shown in FIG. 9D is removed from the connector body 4, the operating part of the actuator member 8 is made to rotate clockwise as indicated by an arrow in FIG. 9C; such that the unlocked state is obtained. At that time, after the sliding surface 8*d* of the rotating actuator member 8 moves around the arc-shaped portion 10Gb of the contact terminal 10*ai*, the pressing surface 8*c* is away from the back plate 6B and the sliding surface 8*d* is guided while being guided along the slant part 10Ga, whereby the flat surface 8*b* of the pressing portion 8A somewhat moves while rotating, until it approaches the back plate 6B. And, as shown in FIG. 9A,the upper surface of the actuator member 8 is brought into contact with the slant 4SL of the socket body 4. Accordingly, since the flat surface 8*b* of the pressing portion 8A somewhat moves until it is close to the back plate 6B while rotating, the opening angle of the actuator member 8 becomes larger in comparison with the prior art device.

The present invention has been described in detail with respect to preferred embodiments, and it will now be apparent from the foregoing to those skilled in the art that changes and modifications may be made without departing from the invention in its broader aspect, and it is the intention, therefore, in the appended claims to cover all such changes and modifications as fall within the true spirit of the invention.

What is claimed is:

1. A cable connector comprising:

a cable accommodating section for accommodating one end of a cable, said cable accommodating section having at least one contact terminal to be electrically connected to a terminal section of said cable and a positioning portion for positioning said cable terminal section relative to said contact terminal, said cable accommodating section communicating with an opening for allowing one end of said cable to contact said positioning portion; and an actuator member disposed in said cable accommodating section, said actuator member being rotatable between a locked position and an unlocked position, said actuator member having a pressing portion comprising a pressing surface for pressing an electrode section of said cable terminal section against a movable contact part of said contact terminal, wherein said contact terminal comprises a fixed portion positioned opposite of said movable contact part, said fixed portion engages said pressing portion of said actuator member as said actuator member rotates between said locked position and said unlocked position, said contact terminal further comprises a flat portion positioned to contact a flat surface of said pressing portion of said actuator member when said actuator member occupies said unlocked position, a concave portion adjacent to said flat portion, said concave portion being positioned to contact said pressing portion when said actuator member occupies said locked position and a position between said locked position and said unlocked position, and an angled portion adiacent to said concave portion, said angled portion being positioned to contact said pressing portion when said actuator member occupies said unlocked position, and when said actuator member occupies said locked position and when said cable terminal section is inserted into said cable accommodating section and said one end of said cable is contacting said positioning portion, a first distance between said positioning portion and a location where said pressing surface contacts said cable terminal section is less than a second distance between said positioning portion and a location where said movable contact part contacts said cable terminal section.

2. A cable connector as claimed in claim 1 comprising:

a plurality of contact terminals, said contact terminals each including a coupling part for coupling said fixed portion to said movable contact part and an opening formed in the coupling part, said opening reducing a capacitance between parallel surfaces of said plurality of said contact terminals.

3. A cable connect or comprising:

a cable accommodating section for accommodating one end of a cable, having contact terminals to be electrically connected to a terminal section of said cable and a positioning portion for positioning said cable terminal section relative to said contact terminals, said cable accommodating section communicating to an opening for allowing said cable terminal section to pass therethrough an actuator member disposed in said cable accommodating section for rotating movement, having a pressing portion in correspondence to the respective contact terminal, said pressing portion comprising a flat surface and a pressing surface for locking or unlocking an electrode section of said cable terminal section inserted into said cable accommodating section relative to a movable contact part of said respective contact terminal, wherein when said actuator member is in a locked or unlocked state, the relative position of the center of rotation of said pressing portion in said actuator member relative to an engagement part of a fixed portion of said contact terminal moves together with rotational movement of said actuator member.

4. A cable connector as claimed in claim 3, wherein when said actuator member is in a locked state, the center of rotation of said pressing portion of said actuator member and a location where said movable contact part contacts said cable lie on a line substantially perpendicular to a surface of said cable.

* * * * *

UNITED STATES PATENT AND TRADEMARK OFFICE

CERTIFICATE OF CORRECTION

PATENT NO. : 7,297,020 B2
APPLICATION NO. : 11/480830
DATED : November 20, 2007
INVENTOR(S) : Hiroshi Takahira et al.

It is certified that error appears in the above-identified patent and that said Letters Patent is hereby corrected as shown below:

Claim 1, column 11, line 19, “adiacent” should read --adjacent--.

Claim 3, column 12, line 4, “connect or” should read --connector--.

Signed and Sealed this

Twenty-seventh Day of May, 2008

JON W. DUDAS
*Director of the United States Patent and Trademark Office*